US005321484A

United States Patent [19]

Kedarnath et al.

[11] Patent Number: 5,321,484

[45] Date of Patent: Jun. 14, 1994

[54] HIGH EFFICIENCY LOW POWER AIR MANIFOLD FOR CLEANER SUBSYSTEMS

[75] Inventors: N. Kedarnath, Mountain View, Calif.; Samuel P. Mordenga, Rochester, N.Y.

[73] Assignee: Xerox Corporation, Stamford, Conn.

[21] Appl. No.: 68,335

[22] Filed: May 28, 1993

[51] Int. Cl.[5] ..... G03G 21/00

[52] U.S. Cl. ..... 355/301; 15/256.51; 118/652; 355/296; 355/298

[58] Field of Search ..... 355/296-298, 355/301-302; 15/256.51, 256.52; 118/652

[56] References Cited

U.S. PATENT DOCUMENTS

| | | | |
|---|---|---|---|
| 4,304,026 | 12/1981 | Borostyan | 355/297 X |
| 5,091,753 | 2/1992 | Slapelis | 355/301 X |
| 5,241,352 | 8/1993 | Lange et al. | 355/301 |

FOREIGN PATENT DOCUMENTS

| | | | |
|---|---|---|---|
| 0161579 | 12/1981 | Japan | 355/301 |
| 0186776 | 10/1983 | Japan | 355/301 |
| 0186778 | 10/1983 | Japan | 355/301 |
| 0011859 | 1/1985 | Japan | 355/298 |
| 0115980 | 6/1985 | Japan | 355/298 |
| 0077781 | 3/1990 | Japan | 355/301 |

*Primary Examiner*—Matthew S. Smith
*Attorney, Agent, or Firm*—Oliff & Berridge

[57] ABSTRACT

A detoning cleaner subsystem for a xerographic machine includes a housing having a longitudinal opening extending on one side thereof and a longitudinally extending rotating brush located therein which cleans toner particles from a moving photoreceptor surface moving past the opening. A longitudinally extending air manifold is located within the housing substantially adjacent the longitudinal opening, near one of first and second air gaps located between the photoreceptor surface and the manifold. The air manifold defines an air channel extending longitudinally substantially the length of the brush. The air channel is in communication with the longitudinal opening. A vacuum source in communication with the air channel provides a longitudinal air flow therethrough for maintaining the dispersed particles aloft and removing the particles. A flicker bar is preferably located between the brush and the air manifold to remove toner accumulation from the brush.

11 Claims, 3 Drawing Sheets

HIGH EFFICIENCY LOW POWER AIR MANIFOLD FOR CLEANER SUBSYSTEMS

BACKGROUND OF THE INVENTION

1. Field of the Invention

The present invention relates to an air manifold for a cleaner subsystem such as those used in xerographic machines. More specifically, a high efficiency air manifold system is provided which enables removal of toner particles from a brush cleaning assembly using less power than conventional systems and providing a more laminar air flow therethrough.

2. Description of Related Art

Cleaner subsystems of xerographic engines employ a variety of techniques to clean a photoreceptor. Several techniques utilize one or more rotating brushes, usually made from insulative or conductive fibers. An integral part of the cleaning process is the cleaning of the brush itself by a brush detoning subsystem. A brush detoning system is utilized to remove accumulated toner particles from the brush fibers and to carry them away to a toner filter or separator. A particular known system shown in FIG. 1 uses a "flicker bar" 16 to knock toner particles from the brush and an air-stream operated under vacuum pressure removes the toner particles dislodged by the "flicker bar".

Numerous problems are associated with detoning systems, such as the one shown in FIGS. 1 and 2. In particular, it is difficult (if not impossible) for known detoning systems to have a uniform air-flow profile across the longitudinal length of the brush. Air-speed profiles for this system shown in FIG. 3 peak near the middle of the span and fall off rapidly towards the longitudinal ends. Additionally, brushes fibers, such as in FIG. 1, offer a high impedance to the air flow in conventional manifolds. In FIGS. 1 and 2, the air flow A, designated flowing in the direction shown by the arrows, is from a photoreceptor cleaner housing gap, at approximately the 5 o'clock and 7 o'clock positions, to the air-manifold located at approximately 12 o'clock in the housing. This forces the air to flow through a large span of brush fibers. At approximately 30000 fibers/in.$^2$ in fiber density, the average cleaning brush offers significant resistance to the flow or air. Thus, high power requirements are necessary to achieve acceptable levels of detoning, i.e., a high air speed and a flow rate of approximately 30 cfm is necessary to maintain removed particles aloft.

OBJECTS AND SUMMARY OF THE INVENTION

It is an object of the present invention to provide an air manifold for a detoning system which has reduced power requirements and a more uniform air-flow profile.

It is another object of the present invention to provide an air manifold and cleaner subsystem which effectively removes toner particles from a cleaner brush at a substantially reduced air flow rate by including a longitudinally extending air manifold located within a housing substantially adjacent a longitudinal opening of the housing and communicating with first and second air gaps located between a photoreceptor surface and the manifold. A rotatable brush is contained in the housing and disperses toner particles from the photoreceptor surface. The air manifold defines an air channel extending longitudinally substantially for the length of the brush. The air channel is in communication with the longitudinal opening. A vacuum source in communication with the air channel provides a longitudinal air flow therethrough for maintaining the dispersed toner particles aloft and removing the dispersed toner particles from the housing. A flicker bar is preferably located between the brush and the air manifold. The air manifold has a substantially reduced air flow resistance due to the air manifold and housing structure.

These and other objects will become apparent from a reading of the following detailed description in connection with the drawings.

BRIEF DESCRIPTION OF THE DRAWINGS

The invention will be described in detail with reference to the following drawings wherein.

DETAILED DESCRIPTION OF PREFERRED EMBODIMENTS

Figure 1:
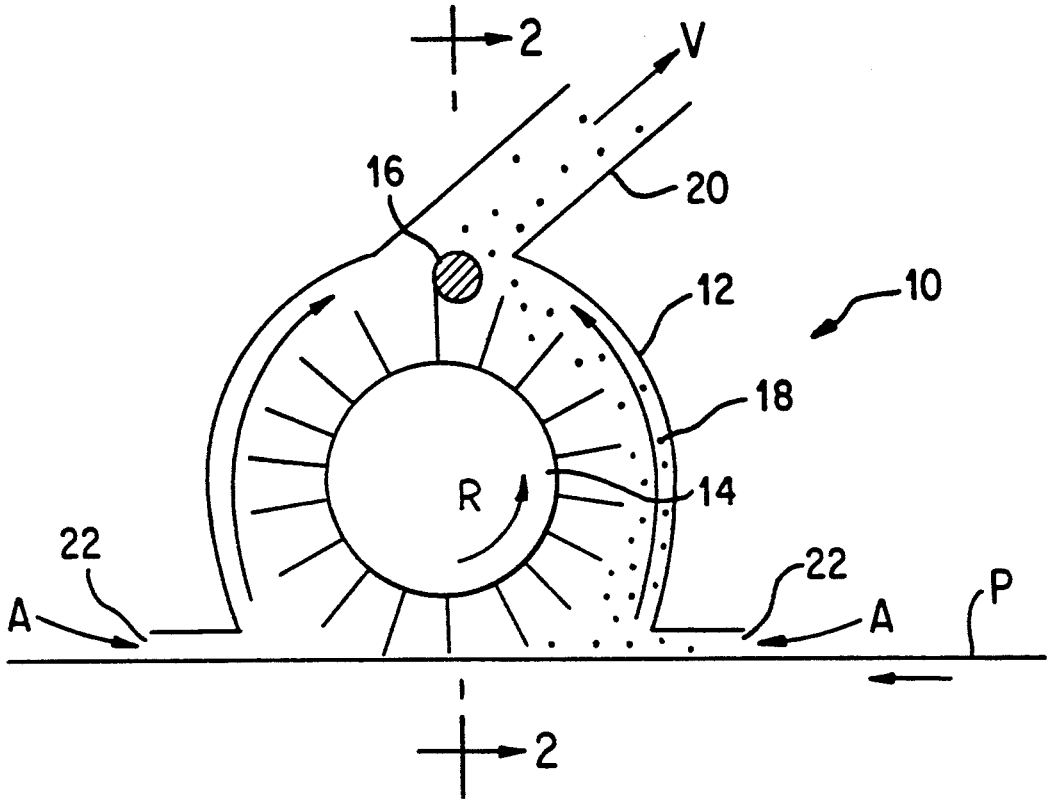
FIG. 1 PRIOR ART
FIG. 1 is a schematic cross-sectional end view of a typical detoning system having a flicker bar.
Figure 2:
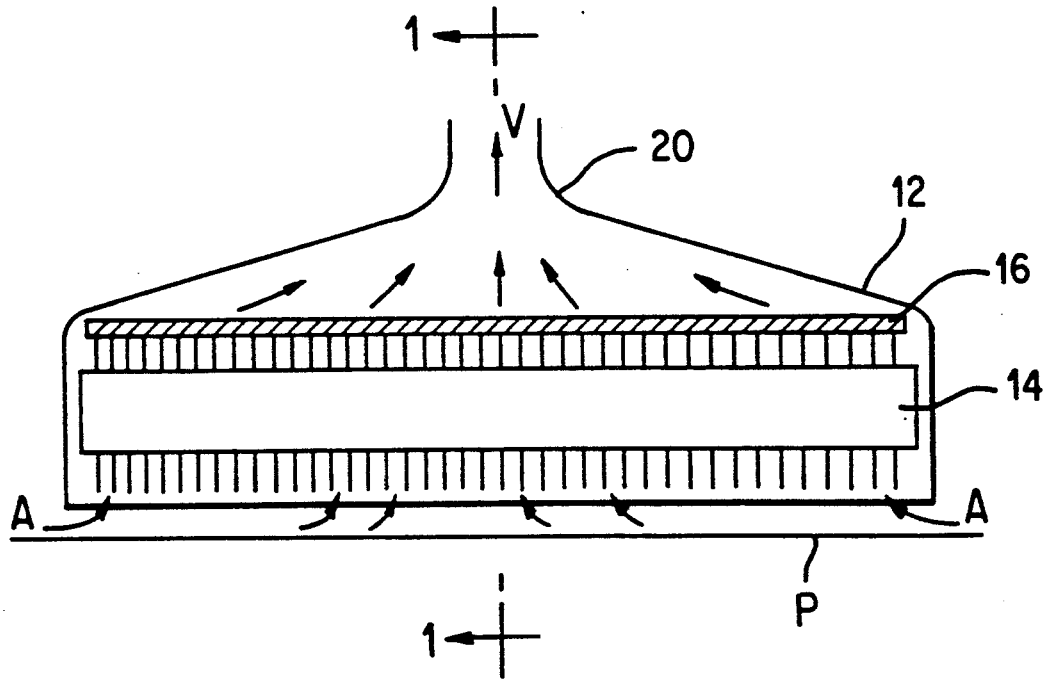
FIG. 2 PRIOR ART
FIG. 2 is a schematic cross-sectional side view of the system in FIG. 1.

With reference to FIGS. 1 and 2, a typical known detoning system 10 is shown which includes a housing 12 which forms an air manifold. The housing is substantially cylindrical and has a longitudinal length sufficient to house a brush 14 of a predetermined length having individual fibers or bristles which extend around brush 14. Brush 14 is rotatable about a fixed axis in a counterclockwise direction as shown by arrow R. The detoning system 10 is located above a moving photoreceptor surface P, which is moving in the direction shown by the arrow. Individual fibers of brush 14 are of a length which allows contact with passing photoreceptor surface P. Air inlet gaps 22 are provided adjacent photoreceptor surface P and extend along the longitudinal length of the air manifold 12. Air gaps 22 provide a path for incoming air.

In operation, brush 14 rotates counterclockwise while photo-receptor surface P moves laterally underneath the air manifold 12. Thus, individual fibers of brush 14 contact photoreceptor surface P and lift any residual toner particles 18 from the surface. Sufficient vacuum applied by vacuum source V provides an air path A, as shown by the corresponding arrows, which draws in air and toner particles 18 into the gaps 22 and through and around the individual brush fibers of brush 14 within air manifold 12. Some toner particles are now airborne while others are now adhered to and between the individual brush fibers.

A flicker bar 16 is located above brush 14 and is positioned such that upon rotation of brush 14, flicker bar 16 contacts individual fibers of brush 14 to "flick" residual toner, shown as particles 18, from the brush. A manifold outlet 20 is located above flicker bar 16 at substantially a 12 o'clock position and is connected to the vacuum source V. Upon individual brush fibers contacting flicker bar 16, adhered toner particles are also released and caused to become airborne in the manifold 20. Sufficient air flow in air path A also draws the airborne toner particles along the air flow path A through manifold outlet 20 to a filter, separator or other system for final removal or storage of accumulated particles 18.

Figure 3:
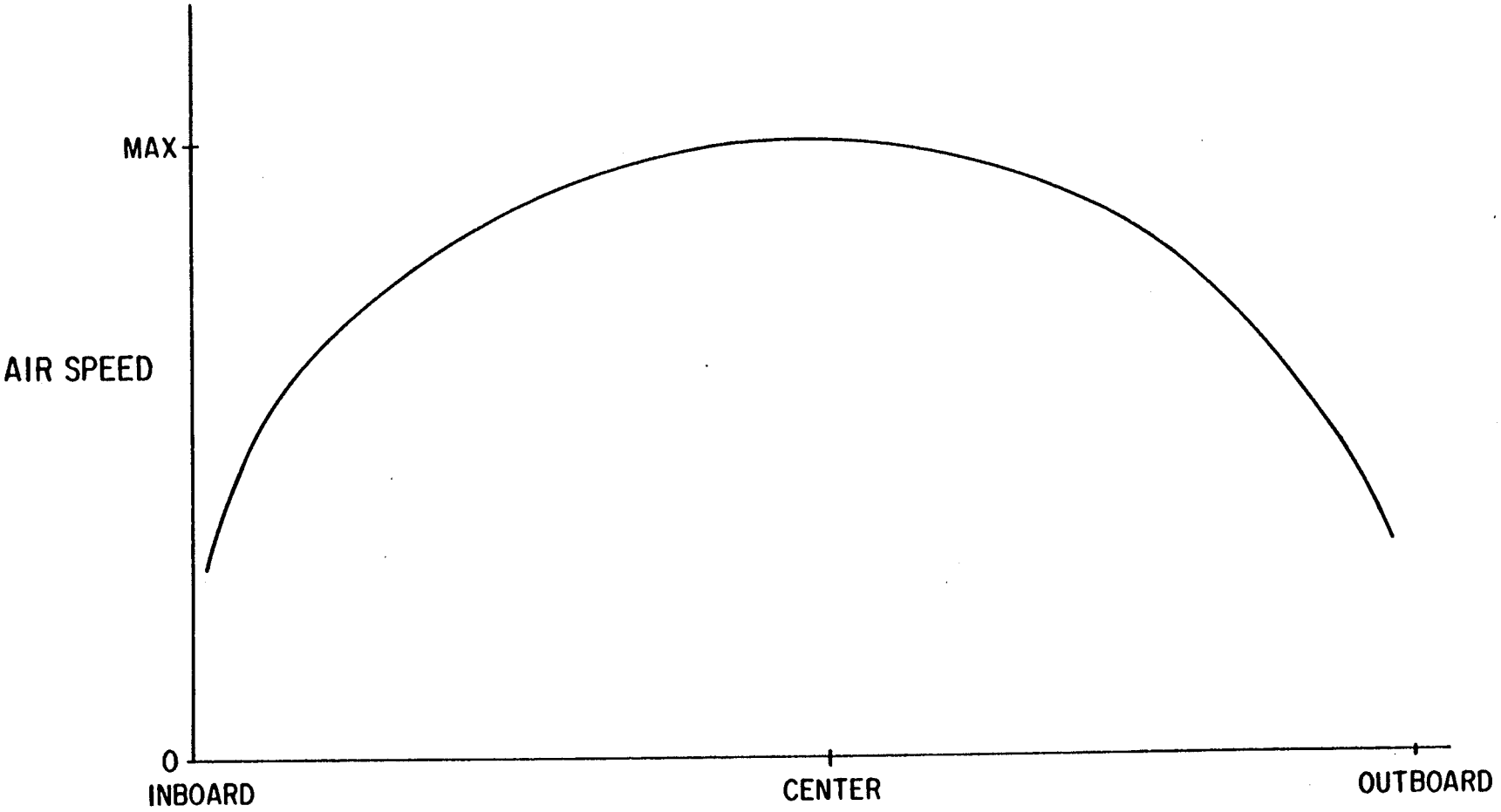
FIG. 3 PRIOR ART
FIG. 3 is a chart showing airflow profile of the system in FIGS. 1 and 2 across the length of the system.

However, such a system inherently has many drawbacks such as the necessity of a large power source to supply adequate vacuum to create an air flow which can overcome the high impedance caused by the individual brush fibers being within the flow path. Without adequate vacuum, some particles 18 may exit out of the air manifold 12 from one or more air gaps 22, accumulate therearound or fall back onto the brush or photoreceptor surface. This is undesirable because it leads to contamination of components external to the air manifold 12, and such components will require manual cleaning by a service technician or operator to remedy. Further, the known system has a long air flow path which requires the air and the toner particles to flow circumferentially around the brush and then radially out the manifold, thereby exacerbating the need for a large vacuum source. Also, because of the relatively large cross-sectional area of the flow path, and the high impedance in the path caused by the bristles, there is a non-uniform air speed/pressure profile which usually peaks near the middle of the longitudinal length of the manifold and tapers off towards the ends thereof (FIG. 3), which may often cause inefficient or incomplete removal of toner particles 18 from the brush 14.

Figure 4:
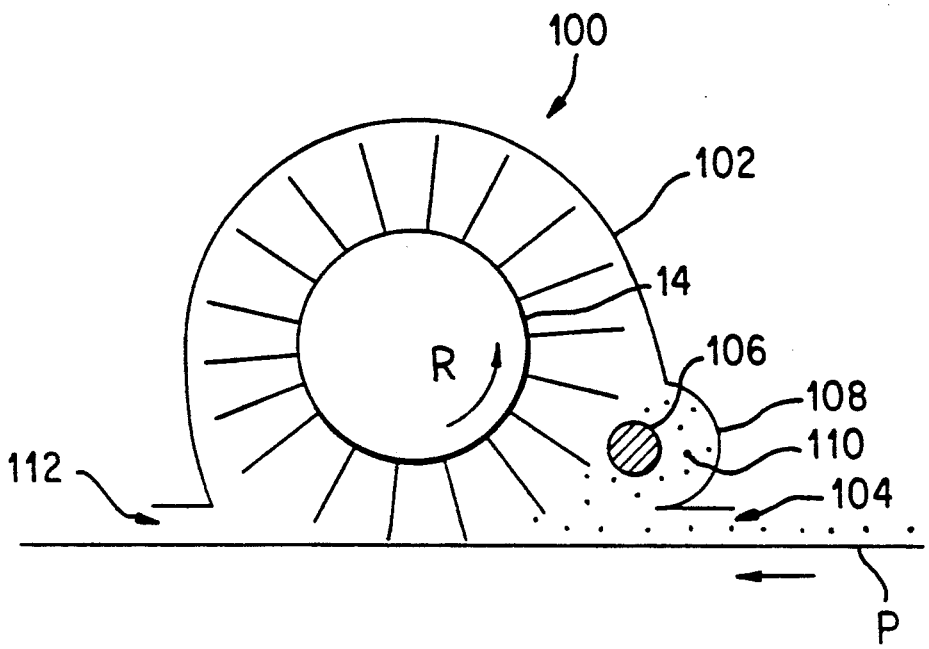
FIG. 4 is a schematic cross-sectional end view of an air manifold for a cleaner subsystem according to the present invention.
Figure 5:
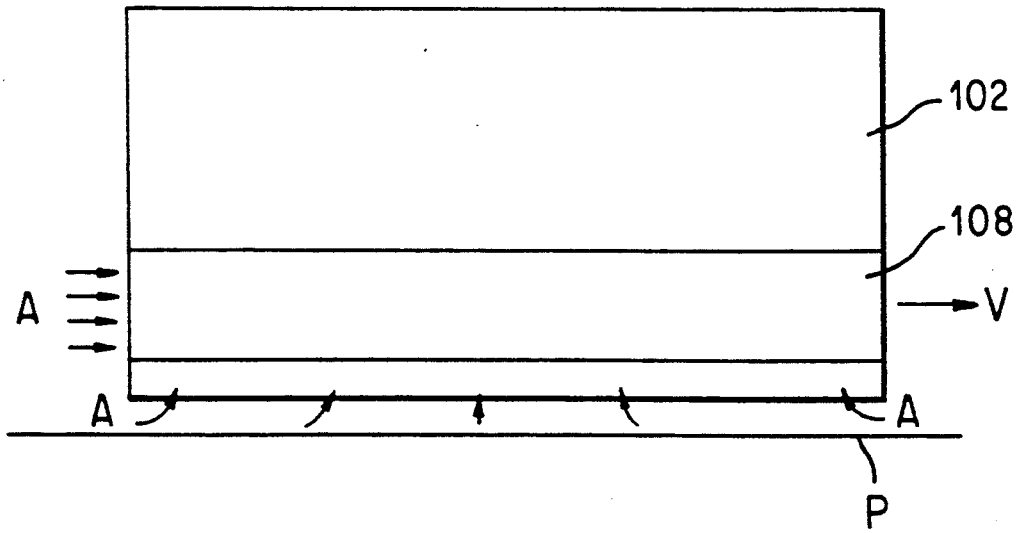
FIG. 5 is a side view of the air manifold shown in FIG. 4.

With reference to FIGS. 4 and 5, the present invention overcomes problems with known systems by providing a detoning system 100 having a cleaner housing 102 and an improved air manifold. A brush 14 remains as in the known system and still rotates counterclockwise about a fixed axis. The cleaner housing 102 has inboard air gap 104 and outboard air gap 112, which allow inlet/outlet passages for air between a photoreceptor surface P labeled in FIG. 4 and cleaner housing 102.

Rather than having a detoning element located in about a 12 o'clock position above the brush 14 as in FIG. 1, the invention provides a detoning element such as flicker bar 106 substantially adjacent the photoreceptor surface P, between the brush 14 and the air gap 104, on the leading edge of the detoning system, relative to the direction of photoreceptor motion. The flicker bar 106 is preferably on the right hand side of the brush 14, when the brush rotates in a counterclockwise direction, at about a 5 o'clock position.

As shown, cleaner housing 102 has an air manifold 108 which defines an air-flow path for removal of "flicked" toner particles or other debris from photoreceptor surface P and brush 14. Air manifold 108 is preferably long and narrow and defines an air channel 110 oriented along the longitudinal axis of the housing and located substantially adjacent the detoning element and substantially adjacent photoreceptor surface P such that airborne particles from either photoreceptor surface P or brush 14 have a minimum distance to travel prior to entering air manifold 108. A vacuum source V (FIG. 5) communicates with air manifold 108 to create a longitudinal air flow from within air manifold portion 108 to a filter, separator or other system for removal or storage of accumulated toner particles and other debris. That is, the toner particles move longitudinally along the air manifold instead of moving circumferentially about the brush and then radially as in FIGS. 1 and 2.

The air manifold portion 108 preferably has a substantially uniform cross-sectional shape, for example semi-circular, which is simple and allows a free flow of air. As seen from FIG. 5, the air manifold portion 108 preferably spans the entire length of the cleaner housing 102. The air manifold portion 108 can extend a lesser length, but should at least extend across the length of brush 14 to adequately provide for removal of toner particles. The manifold is open to the atmosphere on the end opposite the vacuum connection. This allows a free flow of air in the longitudinal direction.

Preferably, vacuum source V is connected to air manifold portion 108 such that the air flow path moves along the longitudinal length of the manifold as shown in FIG. 5, i.e., the vacuum source is located on one end of the longitudinal length of air manifold 108.

Unlike the known system shown in FIG. 1, the present air channel 110 has substantially reduced cross-section dimensions. Further, the air flow path has low-impedance, i.e., has minimal resistance to air flow since a flow path is provided which does not require travelling through brush fibers of brush 14 or circumferentially around the brush. Additionally, an air flow path is not required to move radially outwardly through the housing 102 as in FIG. 1. Preferably, only a minimal area of the internal volume of housing 102 is used as part of the air flow path. This minimal area is preferably an area defined between photoreceptor surface P, brush 14 and air manifold portion 108.

Additionally, since the air channel 110 cross-section is uniform, well-defined and of reduced impedance to air flow, there is better efficiency which allows a reduction of power requirements. This also creates a more uniform air-speed profile, especially when the air manifold is semi-cylindrical. Thus, the present invention is capable of effectively removing airborne toner particles with a substantially reduced air flow. In a particular example there is a 3 fold reduction of air flow rate, from 30 cfm to 10 cfm, over the known system. This allows use of a substantially lower powered vacuum source or the same vacuum source can now provide vacuum to three separate detoning brush systems.

In the known art, such as the cleaner subsystem used in the current Xerox 5090 copier, a flow rate of approximately 15 liters/sec. (around 30 cfm) is required to achieve an acceptable level of detoning performance. This results in an airspeed of around 125 cm/sec (50 ft./sec.) being necessary to keep particles airborne.

In a specific example of the present invention, air manifold 108 defines an air channel 110 having a semi-circular cross-section of 25 mm and a vacuum source creates a flow rate of 5 liters/sec. (about 10 cfm). In this example, the air speed through the manifold is about 150 cm/sec. (around 60 ft./sec.). This is at least as much air speed as the cleaner system air speed of the known art. However, to achieve the same air speed and provide the same or better detoning performance as the known art, this invention requires only one-third the cfm rate. This allows a vacuum source with one-third of the power requirements of the known art to be utilized, or alternatively the same vacuum source as used in the known art could provide vacuum to up to three separate detoning stations in color copiers. Additionally, due to the uniform cross-sectional dimensions of the air manifold channel as compared with the size of the housing, and by using a semi-circular cross-sectional area, the air speed is more uniform across the cross-section.

The invention has been described with reference to the preferred embodiments thereof, which are illustrative and not limiting. Various changes may be made without departing from the spirit and scope of the invention as defined in the appended claims. For example, the direction of rotation of brush 14 can be in a clockwise direction. This however would require relocation of the air manifold and the flicker bar to the opposite side of the housing for proper operation.

What is claimed is:

1. A detoning cleaner subsystem for a photoreceptor surface of a xerographic machine, the photoreceptor surface having toner particles thereon, the subsystem comprising:

a housing having a longitudinal length extending across a width of the photoreceptor surface, a housing width, two longitudinal ends and a longitudinal opening facing the photoreceptor surface;

at least a first longitudinally extending air gap located between said housing and said photoreceptor surface, said gap communicating outside air to said opening;

a longitudinally extending rotatable cleaning brush of a predetermined length located within said housing, said rotating brush having bristles contacting the photoreceptor surface during rotation of said brush to disperse toner particles from the photoreceptor surface;

a longitudinally extending air manifold located within said housing substantially adjacent said air gap, said air manifold defining an air channel extending longitudinally for substantially the predetermined length of said brush, said air channel being in communication with said longitudinal opening;

an open longitudinal end of said air manifold establishing substantially impedance free communication between said air channel and the atmosphere to ensure a free flow of air into said channel; and a vacuum source in communication with said air channel to provide a longitudinal air flow therethrough for removing said dispersed toner particles along the longitudinal length of said housing.

2. The detoning cleaner subsystem of claim 1, further comprising a detoning element, which removes toner particles that collect on said rotating brush, said detoning element dispersing said particles into said air channel.

3. The detoning cleaner subsystem of claim 2, wherein said detoning element is located substantially adjacent said air manifold.

4. The detoning cleaner subsystem of claim 1, wherein said air channel has a largest cross-sectional dimension which is substantially smaller than the width of said housing.

5. The detoning cleaner subsystem of claim 1, wherein said air channel has a largest cross-sectional dimension which is substantially smaller than a length of said air channel.

6. The detoning cleaner subsystem of claim 1, wherein said air manifold provides a uniform pressure profile along the length of said housing.

7. A detoning cleaner subsystem for a photoreceptor surface of a xerographic machine, the photoreceptor surface having toner particles thereon, the subsystem comprising:

a longitudinally extending housing having two ends, a longitudinal length extending across a width of the photoreceptor surface and a longitudinal opening facing the photoreceptor surface;

first and second longitudinally extending air gaps located between said housing and said photoreceptor surface, said first and second air gaps communicating outside air to said opening;

a longitudinally extending rotatable cleaning brush of a predetermined length located within said housing, said rotating brush having bristles contacting the photoreceptor surface during rotation of said brush to disperse toner particles from said photoreceptor surface into said housing;

a longitudinally extending air manifold having first and second ends located within said housing, said air manifold defining an air channel extending longitudinally for substantially the predetermined length of said brush, said air channel being in communication with said longitudinal opening and said first and second air gaps for providing a longitudinal air flow, said first end having an aperture communicating with outside air; and a vacuum source in communication with said air channel at said second end to provide a longitudinal air flow therethrough.

8. The detoning cleaner subsystem of claim 7, wherein said air channel has a largest cross-sectional dimension substantially smaller than a length of said air channel.

9. The detoning cleaner subsystem of claim 7, further comprising a detoning element between said rotating brush and said air manifold, said detoning element being contacted by said bristles during rotation of said brush.

10. The detoning cleaner subsystem of claim 9, wherein said detoning element and said air manifold are substantially adjacent said longitudinal opening.

11. The detoning cleaner subsystem of claim 7, wherein said vacuum provides an air flow rate of 10 cfm. and higher to maintain said particles aloft.

* * * * *